United States Patent [19]

Ewing

[11] 4,378,088

[45] Mar. 29, 1983

[54] LIQUID ATOMIZING METHOD AND APPARATUS

[76] Inventor: James W. Ewing, 138 E. Hillside Rd., Barrington, Ill. 60010

[21] Appl. No.: 51,830

[22] Filed: Jun. 25, 1979

[51] Int. Cl.[3] ..... B05B 3/14

[52] U.S. Cl. ..... 239/8; 239/102; 239/327

[58] Field of Search ..... 239/102, 327, 4, 427.5, 239/431, 424.5, 490, 492; 261/DIG. 48

[56] References Cited

U.S. PATENT DOCUMENTS

| | | | |
|---|---|---|---|
| 3,240,254 | 3/1966 | Hughes | 239/102 X |
| 3,297,255 | 1/1967 | Fortman | 239/102 |
| 3,542,291 | 11/1970 | Hughes | 239/102 X |
| 3,554,443 | 1/1971 | Hughes | 239/102 X |
| 3,899,130 | 8/1975 | Bell | 239/102 |
| 4,087,495 | 5/1978 | Umehara | 239/102 X |
| 4,141,939 | 2/1979 | Oshina | 239/102 X |
| 4,165,961 | 8/1979 | Yamoto et al. | 239/102 X |

*Primary Examiner*—Andres Kashnikow
*Assistant Examiner*—Gene A. Church
*Attorney, Agent, or Firm*—Lee, Smith & Jager

[57] ABSTRACT

A liquid atomizing method and apparatus in which atomization is achieved through acceleration of a primary air flow injected through an upstream throat (58*t*) into a diverging passage (61) between the upstream throat (58*t*) and a downstream throat (68) to create shock waves in the air flow which impact a wall surface adjacent and generally opposed to a confined liquid column to create sonic and/or ultrasonic vibrations which are directed into the confined liquid column to cause the column to fracture into tiny droplets of a narrow size range below 50 microns in diameter. One or more auxiliary air flows may be injected through other upstream throats (60*t*) into the diverging passage (61) in the flow direction of the primary air flow downstream of the first throat to supply energy to the boundary layer and to enhance acceleration of the primary jet through entrainment. The effective cross-sectional flow area of the downstream throat (68) is between 1.25 and 1.50 times the combined effective cross-sectional flow area of the upstream throats (58*t*, 60*t*).

23 Claims, 12 Drawing Figures

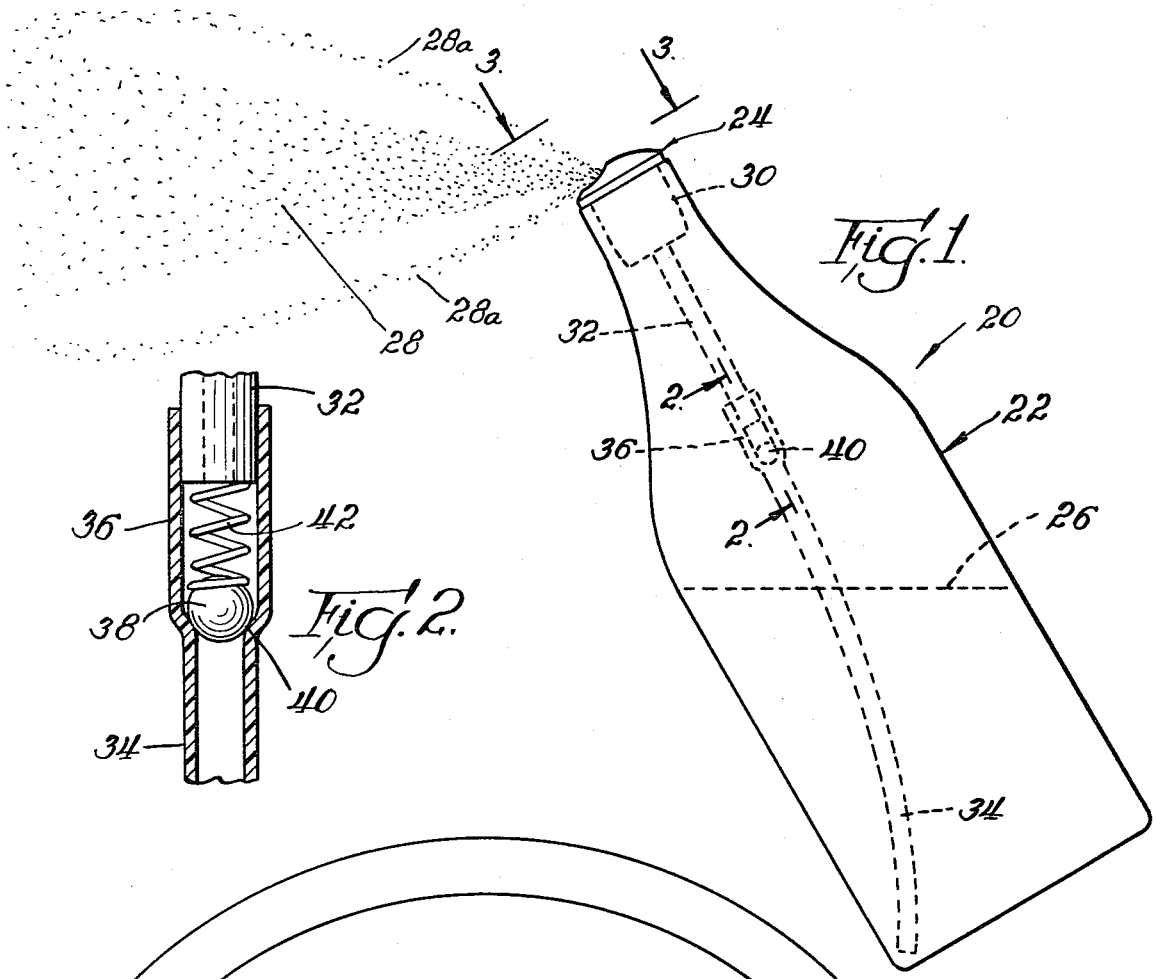
Fig. 1.
Fig. 2.
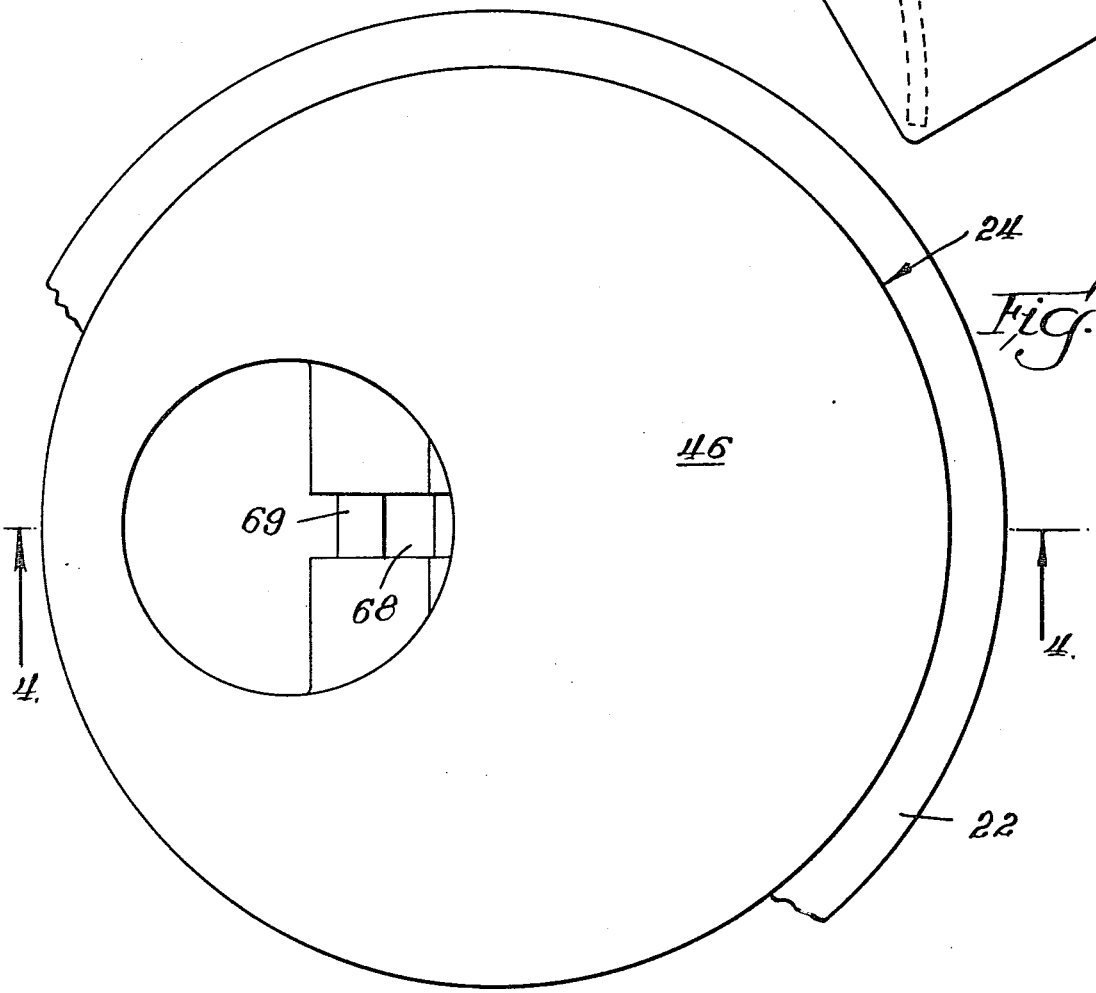
Fig. 3.

8.
6.
7.
5.
68
67
62
64
55
66
69
46
24
56
48
52
50
44
22
54
32

56
32
58
52
60
48
54
50
69
55
22
44

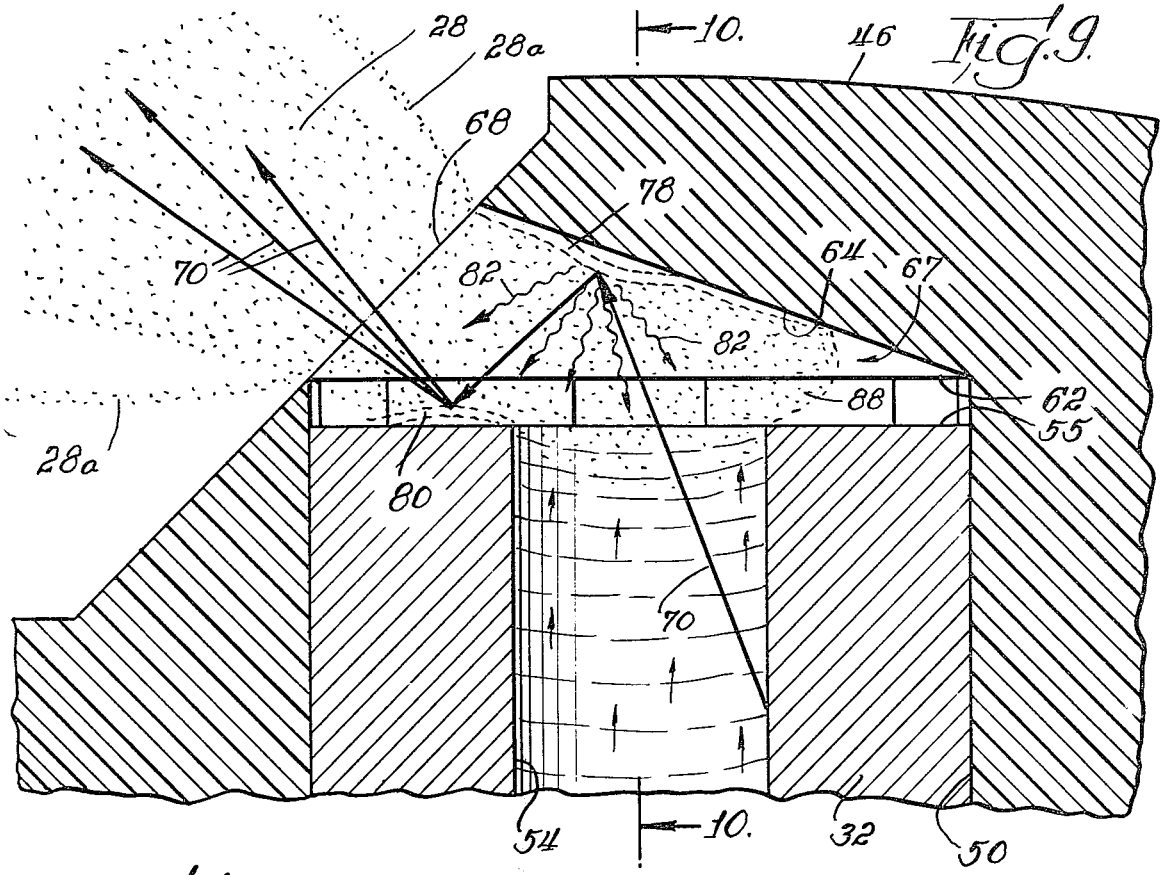
Fig. 9
Fig. 10
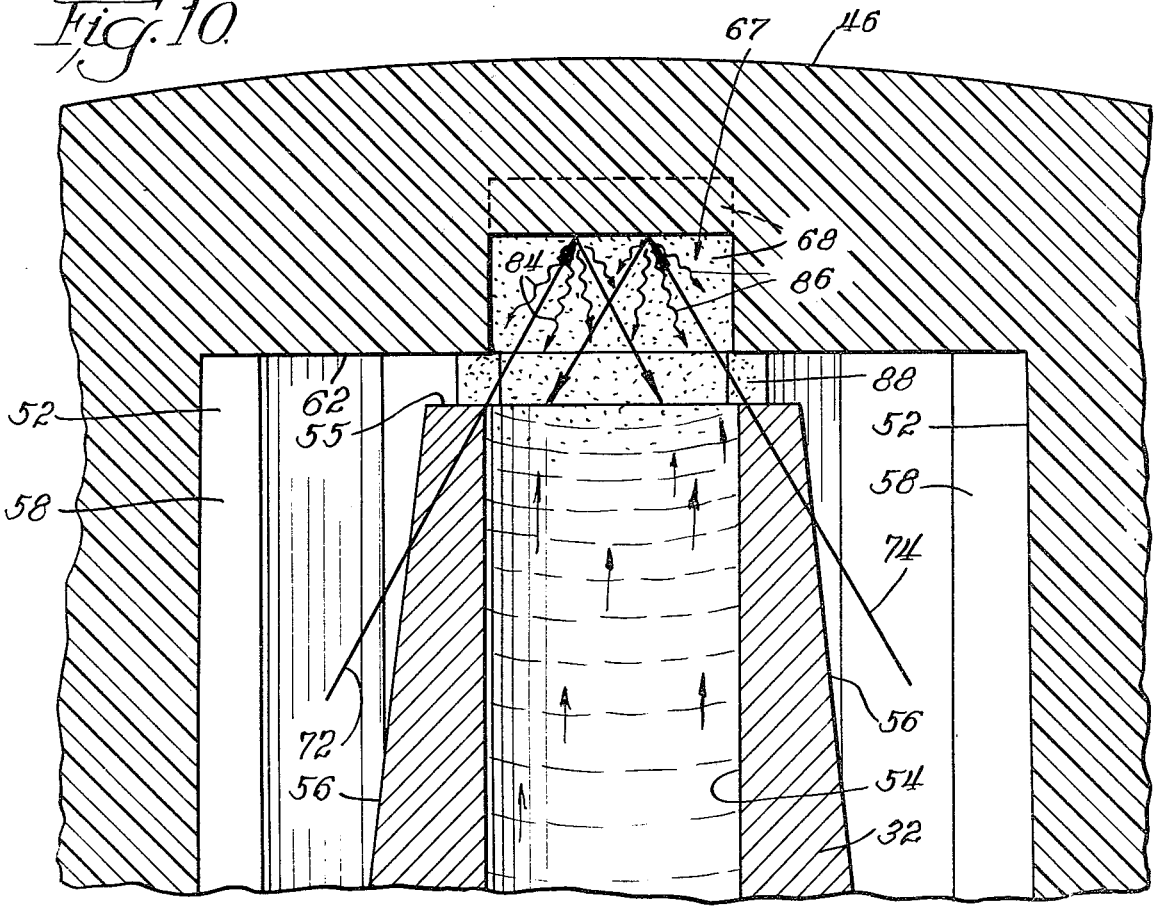

28a
68a
67
64
28
68b
28a
60
55
58
88
62
60
54
76
56
56
61
61
60t
60t
58t
58a
60a
60a
32

LIQUID ATOMIZING METHOD AND APPARATUS

DESCRIPTION

1. Technical Field

The invention relates to a method and apparatus for achieving atomization of a liquid characterized by extremely small droplets within a narrow size range. More particularly, the invention employs a shock wave technique for creating sonic and/or ultrasonic vibrations to shatter a confined column of liquid into a mist composed of droplets of a narrow size range below 50 microns in diameter.

2. Background Art

Hand sprayers of pump or squeeze bottle type are in very common use for spraying liquids such as deodorants, hair spray, cologne, etc. Typical hand sprayers produce droplets ranging in size from 0 to 250 microns in diameter. With the very low upstream input or back pressure available in typical hand sprayers, 1 to 2 pounds per square inch gauge (psig), it has not been possible heretofore to achieve droplet sizes in a very narrow size range no greater than 50 microns in diameter.

Even with atomizing devices employing higher upstream input pressure the achievement of uniform droplet sizes below 50 microns is difficult and usually entails substantial back pressure and the use of baffles, screens or other mechanical devices to assist in droplet breakup.

For a number of years those working in the atomization arts have employed sonic and supersonic wave generators to assist in atomization. Typical of such prior art devices are those disclosed in Hughes U.S. Pat. No. 3,240,253 and Hughes U.S. Pat. No. 3,240,254 (which refer back to earlier Hughes U.S. Pat. No. 3,230,923 and No. 3,230,924). These Hughes patents disclose the use of convergent-divergent nozzles to achieve supersonic air flow in conjunction with Hartmann generators to create sonic resonance into which streams of liquid are injected for atomization purposes.

With specific reference to Hughes U.S. Pat. No. 3,240,253, FIGS. 4 and 5, the lowest mean droplet size achieved by Hughes was approximately 60 microns at substantial input air pressures, approximately 100 pounds per square inch absolute (psia). Hughes discloses that mean droplet size increases essentially geometrically with reduced input pressure, showing mean droplet size over 100 microns at an input pressure of approximately 19.7 psia. It is noted that since Hughes discloses mean droplet size, by definition, half of the droplets at any particular point on the Hughes curves would be of a larger size. Although most of the examples given by Hughes relate to atomization of fuel oil, it is noted that the droplet size achieved by Hughes is stated by him to be relatively independent of the viscosity (e.g., Hughes U.S. Pat. No. 3,240,253, column 10, lines 9–20).

Other examples of atomization devices employing supersonic gas streams are disclosed in Hughes U.S. Pat. Nos. 3,531,048, No. 3,542,291, No. 3,554,443 and No. 3,558,056. In the devices of all four of these later patents Hughes assertedly obtains supersonic gas velocity through boundary layer "sculpting". According to Hughes, the build up and then the deterioration of the boundary layer in a straight-sided nozzle causes the gas stream to accelerate to supersonic, with the boundary layer forming what is akin to a convergent-divergent supersonic nozzle. In each of these patents, Hughes discloses that the liquid to be atomized is introduced into the gas stream prior to or at about the time of acceleration to sonic velocity. In Hughes U.S. Pat. No. 3,354,443, Hughes also employs a Helmholtz resonator to reinforce the shock waves in the supersonic stream.

An earlier device for atomizing a liquid by supersonic sound vibrations is disclosed in Joeck U.S. Pat. No. 2,532,554. Joeck talks in terms of "breaking up" a liquid stream into finely divided droplets by introducing the liquid into a high velocity gas stream, assertedly supersonic.

The Hughes patents and the Joeck patent disclosed above are the closest prior art known to applicant and his attorney relative to the present invention.

DISCLOSURE OF INVENTION

Applicant obtains extremely small droplet sizes by creating shock waves in a high speed air flow in diverging passages (that is, passages of successively increasing cross-sectional areas) and causing these shock waves to impact against a wall surface to trigger sonic and/or ultrasonic vibrations which are directed into a confined column or stream of liquid such as water. The sonic and/or ultrasonic vibrations in the confined column of liquid cause it to fracture and to emerge as a fog-like flow comprised of droplets of extremely small size.

The shock waves in the air flow are achieved even though the input air pressure is as low as 1 to 2 psi, and these shock waves occur in a passage between a composite inlet or upstream throat and a single outlet or downstream throat, with the effective cross-sectional flow area of the outlet throat being approximately one-third larger than the effective cross-sectional flow area of the composite inlet throat. The shock wave and sonic and/or ultrasonic vibration phenomena which cause the liquid to fracture into a mist of extremely small droplets is approximately equally operative when the effective cross-sectional flow area of the downstream throat is in the range of from 1.25 to 1.5 times the effective cross-sectional flow area of the composite throat. From observation of models and from high speed photography, it has been determined that shock waves are indeed formed during operation even though the input pressure is so low as to indicate against the achievement of supersonic flow between the composite upstream throat and the downstream throat.

The resulting flow is ejected from the downstream throat as a fine spray at a substantial forward velocity in the form of droplets in a very narrow size range of 50 microns or less.

BRIEF DESCRIPTION OF DRAWINGS

FIG. 1 is an elevational view of a spray device incorporating the atomizing method and apparatus of the present invention;

FIG. 2 is an enlarged fragmentary sectional view of a portion of the apparatus of FIG. 1 taken along line 2—2 thereof;

FIG. 3 is an enlarged elevational view of the top end of the apparatus taken along line 3—3 of FIG. 1;

FIG. 9 is a further enlarged fragmentary sectional view taken along line 9—9 of FIG. 6, schematically illustrating the atomization phenomenon in operation;

FIG. 10 is a fragmentary sectional view taken along line 10—10 of FIG. 9 and to the same scale as FIG. 9, further schematically illustrating the atomization phenomenon in operation;

BEST MODE OF CARRYING OUT THE INVENTION

Figure 4:
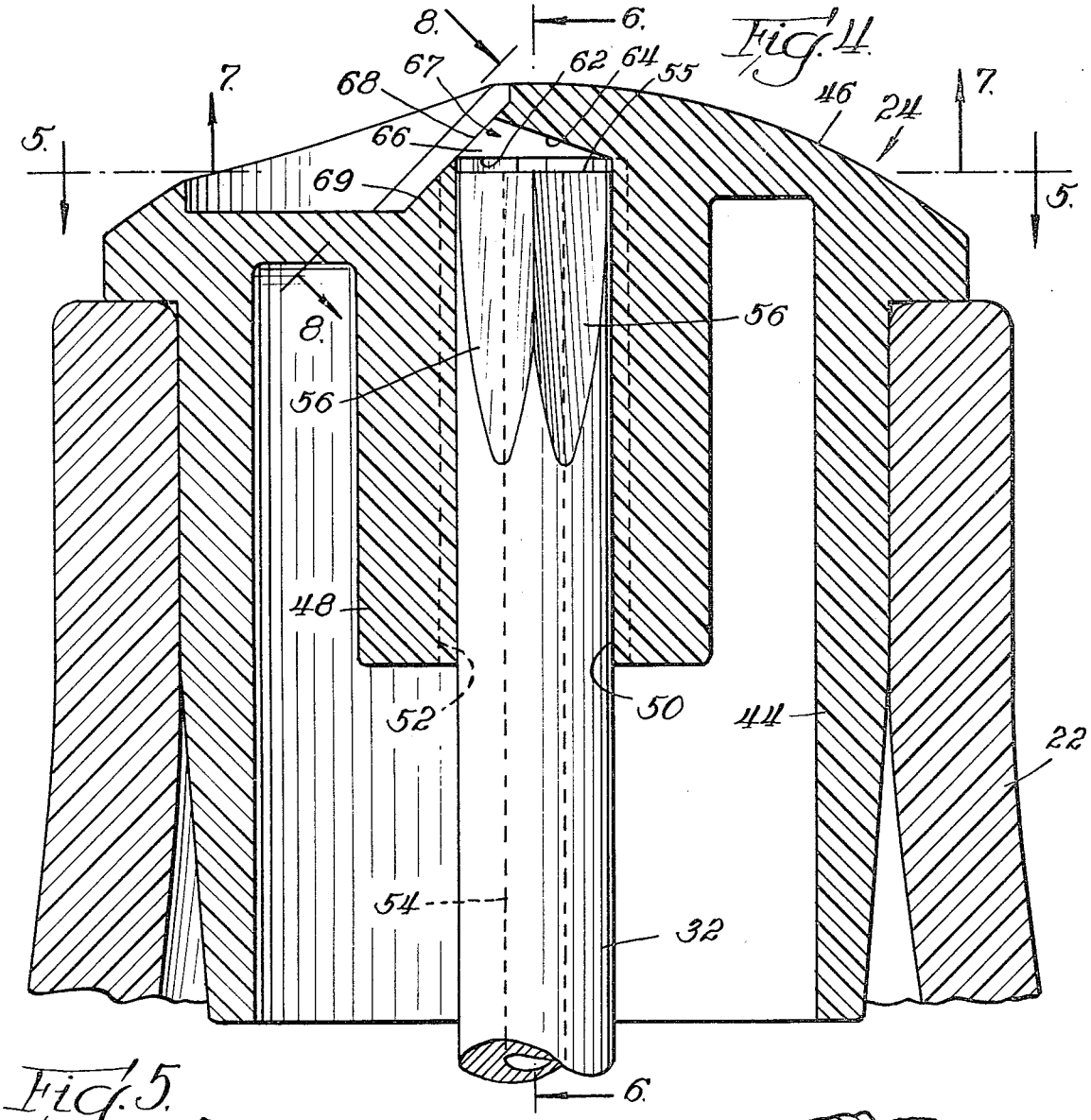
FIG. 4 is a sectional view taken along line 4—4 of FIG. 3.

The atomizing apparatus of the present invention is generally designated by the reference numeral 20 in FIG. 1. The apparatus includes a deformable plastic container 22 which incorporates a spray apparatus designated as 24. The container 22 is of the "squeeze bottle" type partly filled with a liquid to be sprayed, such as water, deodorant, hairspray, cologne or the like generally designated 26. The remainder of the bottle is filled with air at atmospheric pressure. When the bottle is squeezed or deformed by the user, pressure is created in the bottle causing the liquid to be ejected by the spray apparatus 24 in the form of a fine mist, the main body of which is designated by the reference numeral 28. A few droplets **28*a*** are carried 9 to 10 inches away from the main spray, as shown, by the force of exiting shock waves as described in more detail subsequently herein.

The spray apparatus 24 includes a spray plug 30 to which is connected a rigid liquid supply pipe 32 and which is in turn connected to a flexible dip tube 34, the bottom portion of which is immersed in the liquid 26. Aside from the novel construction and operation of the spray apparatus to be described, the general arrangement described thus far is quite similar to the squeeze bottle spray apparatus shown in Montenier U.S. Pat. No. 2,642,313.

As best seen in FIG. 2, the dip tube has an enlarged upper end portion 36 in which the lower end portion of the supply pipe 32 is inserted and secured in liquid-tight fashion. A ball check valve is located within the tube enlargement 36 and comprises a ball member 38 normally seated against an annular valve seat 40. The ball 38 normally is urged in fluid-tight fashion against the seat 40 by means of gravity and a light compression spring 42 which is compressed between the ball member 38 and the lower end of the liquid supply pipe 32. When the squeeze bottle 22 is deformed, the air above the liquid 26 is compressed forcing the liquid to rise in the dip tube 34. When the liquid rises in the dip tube sufficiently to open the ball check valve, the liquid can pass upwardly into the liquid supply pipe 32 and into the spray plug 30. When the squeeze bottle is released, the supply pipe 32 will remain completely filled by reason of the well-known closing action of the ball check valve.

The dip tube and check valve arrangement is very similar to that of the spray apparatus shown in Ewing et al U.S. Pat. No. 3,316,559, an invention of the present applicant with another.

The spray plug 30 is similar in general external configuration to the discharge nozzle device shown and described in applicant's above mentioned U.S. Pat. No. 3,316,559. The plug 30 is preferably molded of semirigid plastic such as polyethylene or polypropylene, but it may be formed of metal or some other rigid material if desired. As seen in FIGS. 3–6 the plug includes a cylindrical outer annular portion 44, a dome portion 46 and a cylindrical inner annular sleeve portion 48, all integral. The outer cylindrical portion 44 is adapted for being secured in the upper end portion of the squeeze bottle 22, as shown in FIG. 1.

The present invention resides in the configuration and coaction of the cooperating portions of the spray plug 30 and the liquid supply pipe 32. As described in detail hereinafter, the arrangement provides air passages which when the bottle 22 is squeezed, coact to achieve acceleration of air flow sufficient to create shock waves which are impinged against a wall surface to create sonic and/or ultrasonic vibrations which are reflected into the confined liquid flow before it emerges from the supply pipe 32, causing fracturing of the confined liquid into extremely fine droplets of a narrow size range.

Figure 5:
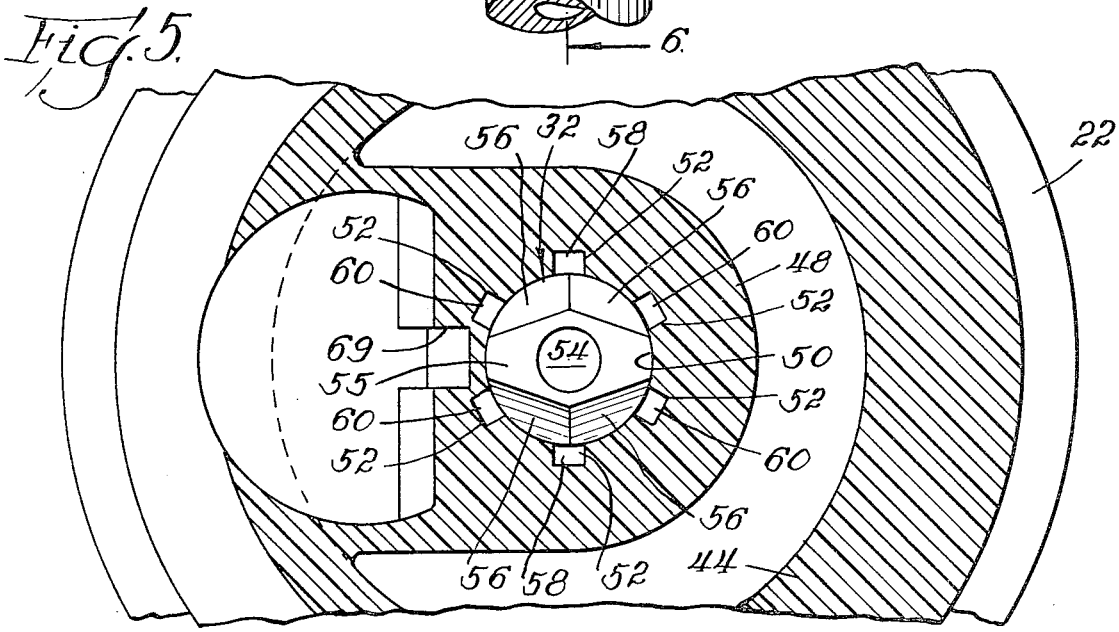
FIG. 5 is a fragmentary section view taken along line 5—5 of FIG. 4.
Figure 6:
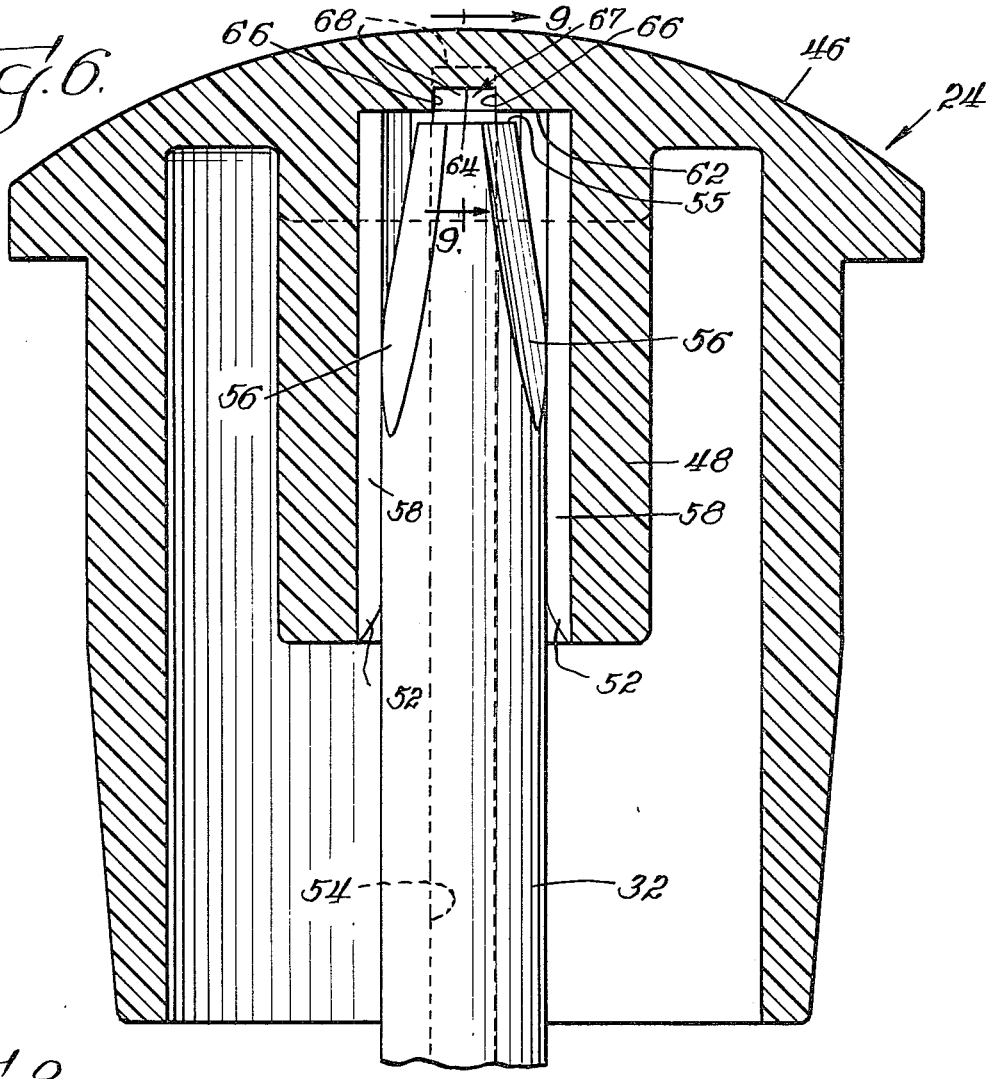
FIG. 6 is a sectional view taken along line 6—6 of FIG. 4.
Figure 8:
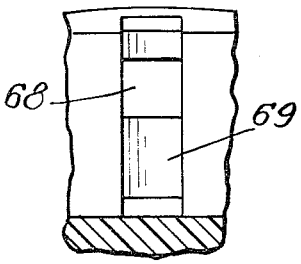
FIG. 8 is a fragmentary elevational view, partly in section, taken along line 8—8 of FIG. 4.
Figure 7:
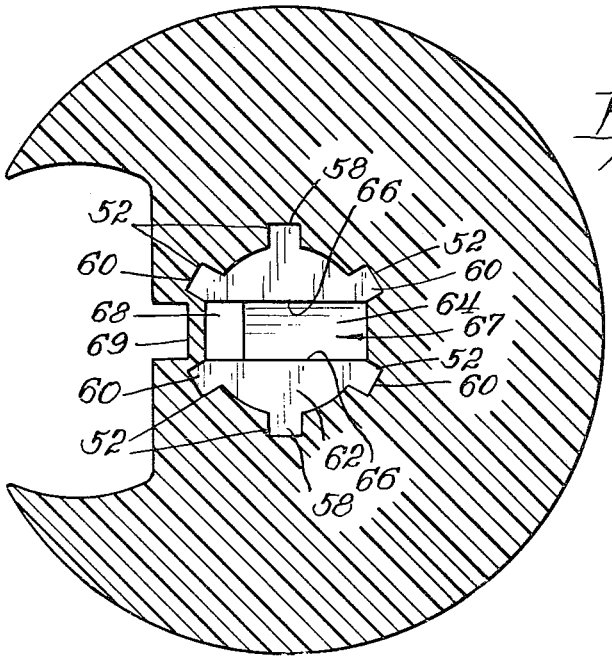
FIG. 7 is a fragmentary sectional view taken along line 7—7 of FIG. 4.

As best seen in FIGS. 4, 5 and 6 the upper end portion of the liquid supply pipe 32 is snugly held in a central cylindrical cavity 50 of the sleeve portion 48. Six longitudinal grooves 52 are formed in the inner wall of the cavity 50 and are equally spaced around the periphery. The grooves 52 are slightly tapered inwardly from their bottom ends toward the top. With the pipe 32 secured within the cavity 50 as shown, the grooves 52 provide six air flow passages which are circumferentially spaced about the outer periphery of the pipe. A central liquid flow passage 54 is formed within the pipe 32, terminating at an opening at an upper end surface 55 of the pipe.

Figure 12:
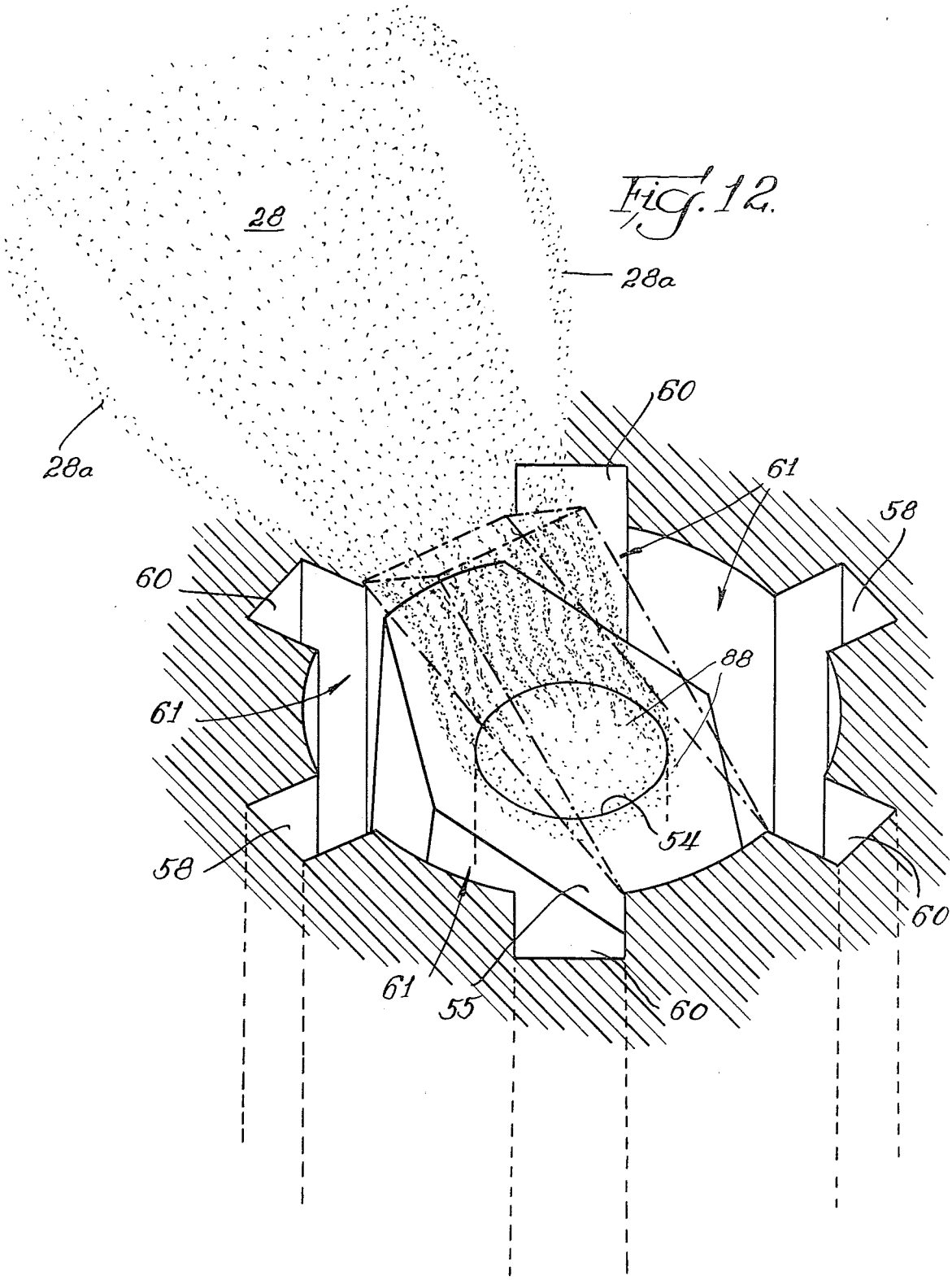
FIG. 12 is a fragmentary perspective view partly in section and partly schematic and to the same scale as FIGS. 9 and 10, with the atomization phenomenon further schematically illustrated.

The outer surface of the upper end portion of the liquid supply pipe 32 is scarfed or chamfered, with two angularly disposed flat chamfers 56 formed at each side. Consequently, the outer periphery of the end portion of the pipe is generally diamond shaped in cross-section as best seen in FIGS. 5 and 12, and the diamond shape gradually fairs into the round cross-sectional configuration of the outer surface of the pipe below the chamfers 56. The arrangement is such as to form three air flow passages on each side of the pipe 32, the center one of each group of three being the main or primary passage generally designated by the reference numeral 58, and the two flanking passages of each group being side or auxiliary passages generally designated by the reference numeral 60.

Figure 11:
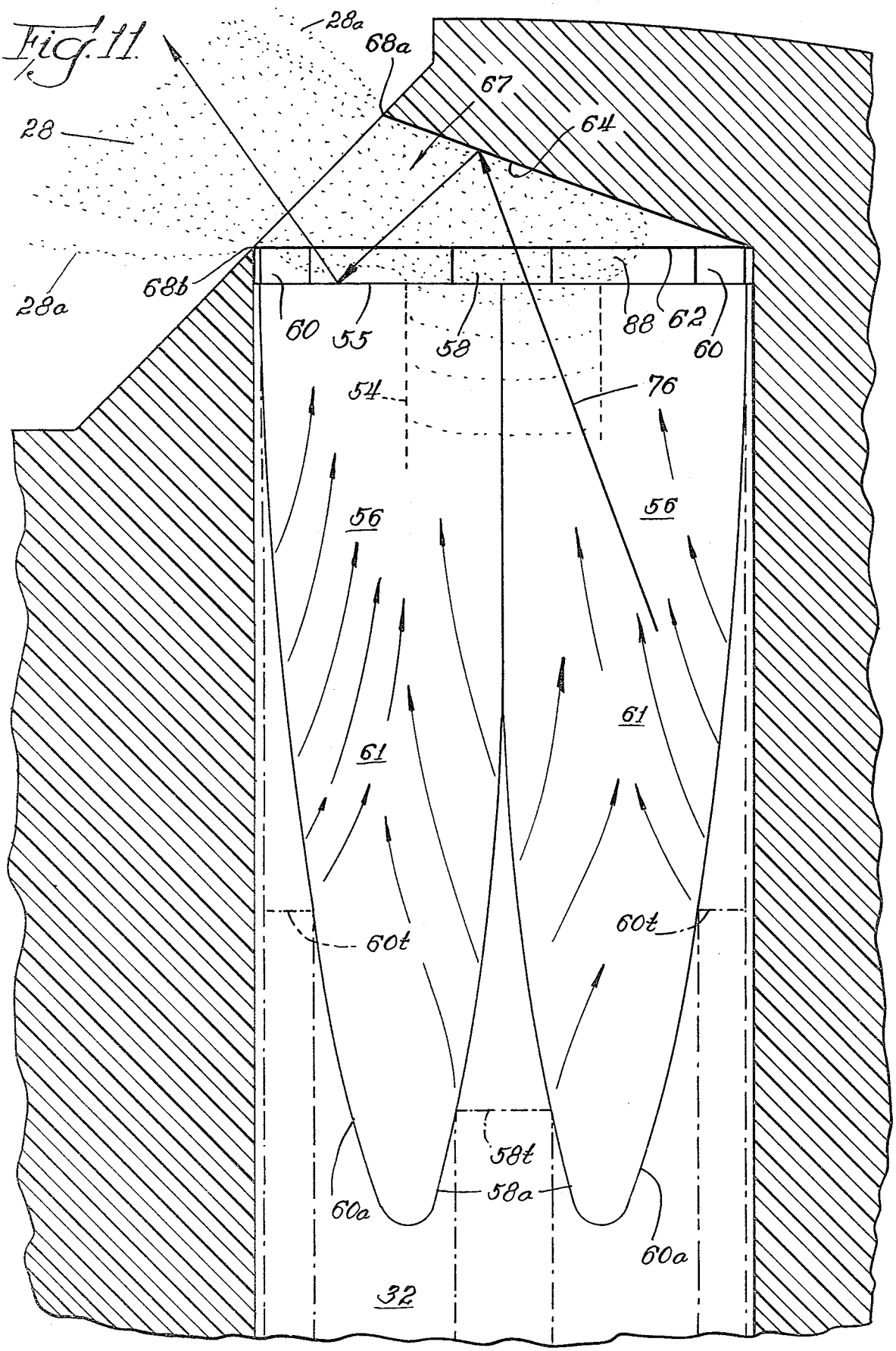
FIG. 11 is an enlarged fragmentary sectional view similar to FIG. 9 and to the same scale but showing the end portion of the liquid pipe in elevation, further schematically illustrating the atomization phenomenon in operation.

With specific reference to FIGS. 5 and 11, the air flow passages 58 and 60 are of a convergent-divergent form. As previously mentioned, the passages 52 are slightly flared toward their bottom ends, so that the passages 58 and 60 formed by grooves 52 and the circumferential surface of the liquid supply pipe 32 are slightly convergent in the direction of air flow until the chamfers 56 are encountered. At this point the narrowest constriction in each passage is reached. With reference to FIG. 11, in each of the primary passages 58 the point of narrowest constriction constitutes a throat **58*t* (at the phantom line shown), and in each of the auxiliary passages 60 the point of narrowest constriction constitutes a throat 60***t* (at the phantom lines shown). The portions of the primary and secondary passages upstream of the throats 58*t* and 60*t* are designated 58*a* and 60*a*, respectively, and the common diverging passage downstream of the throats is designated 61. Accordingly, the air flow passages 58 and 60 are constructed in convergent-divergent nozzle form, with the convergent section being the portion upstream of the respective throats 58*t* and 60*t* and the divergent section being the common diverging passage 61.

In an operating embodiment of the invention as shown and described the grooves 52 are 0.013 inches deep. The grooves 52 defining the primary air flow passages 58 encounter the scarfed surfaces 56 at a point where the width of the grooves 52 is 0.032 inches. The auxiliary passages 60 do not reach the scarfed surfaces 56 until farther downstream, so that because of the taper in the grooves 52 the width at that point is approximately 0.025 inches. Accordingly, each of the throats 58*t* of the primary air flow passages 58 is 0.013 inches by 0.032 inches in dimension, while each auxiliary air flow passages 60 has a slightly smaller throat 60*t* of 0.013 by 0.025 inches in dimension. Downstream of the throats 58*t* and 60*t* the air passages open into the common diverging passage 61 defined by the scarfed surfaces 56.

The cavity 50 in the sleeve portion 48 terminates at an end wall 62. A ramp 64 is formed in the central portion of the end wall and extends angularly upwardly from right to left as seen in FIGS. 4, 9, and 11. Parallel side walls 66 join the ramp 64 to define a ramped channel 67 leading to an exit orifice 68 exiting to the atmosphere. The exit orifice 68 is formed in an exterior surface 69 of a depressed region of the dome portion 46, with the surface disposed at about a 45° angle to the central axis of the spray plug.

In the embodiment of the invention being described the outside diameter of the liquid supply pipe 32 below the scarfed surfaces 56 is 0.114 inches, while the diameter of the liquid passage 54 is 0.042 inches. The liquid supply pipe 32 is secured in the cavity with its end surface 55 spaced 0.015 to 0.020 inches from the end wall 62 of the cavity.

It will be noted that the exit orifice 68 is provided with relatively sharp or feather edges 68*a* and 68*b*, top and bottom, respectively. It has been determined experimentally that at least two of the edges of the orifice 68 must be relatively sharp or else the spray which is ejected becomes much poorer, that is, droplet size becomes substantially larger than the desired 50 microns maximum. It has been determined experimentally that a rectangular orifice with all four edges no greater than 0.025 inches in thickness in the flow direction will work satisfactorily, but if the edge thickness is increased to 0.040 inches or over, the spray becomes unsatisfactory. The same occurs with respect to a round exit orifice, that is, an edge thickness of 0.040 inches or over causes a much poorer spray while an edge thickness below 0.025 inches results in a satisfactory spray. It is believed that the exit orifice edge, if relatively thick, impedes or prevents the reflected shock waves from passing out the exit orifice. A relatively thick orifice may serve to reduce the mass flow through the exit which in turn decreases the velocity between the two throats. In the particular embodiment of the invention depicted the exit orifice 68 is of rectangular configuration 0.040 inches wide (the same as the distance between the side walls 66) and 0.036 inches deep (the distance between the sharp edges 68*a* and 68*b*).

As best seen in FIGS. 9 and 10, the ramped channel 67 leading to the exit orifice 68 is open at its bottom. Accordingly, the combined cross-sectional open area of the ramped channel 67 and the connected space below the end wall 62 and above the end surface 55 of the liquid supply pipe 32 is considerably larger than the cross-sectional area of the exit orifice 68, particularly as the exit orifice is approached.

The dimensions and configuration of the liquid supply pipe 32, the scarfed surfaces 56 of the liquid supply pipe, the spacing of the upper end of the liquid supply pipe from the end wall 62 of the cavity 50, the width and depth of the grooves 52, the continuous length of the grooves 52 throughout the cavity 50, and the size of the exit orifice 68 are deliberately chosen to create the effect of two throats in series in the air flow system from the interior of the squeeze bottle 22 to the atmosphere. The six throats 58*t* and 60*t* comprise a composite upstream throat, while the exit orifice 68 forms a single downstream throat. In the embodiment shown the physical cross-sectional area of each of the upstream throats 58*t* is 0.000416 square inches, while the physical cross-sectional area of each of the upstream throats 60*t* is 0.000325 square inches, for a total of 0.002132 square inches for the composite upstream throat. The physical cross-sectional area of the downstream orifice or throat 68 is 0.00144 square inches.

Notwithstanding the physical dimensions, the effective cross-sectional flow area of the downstream throat is larger than the effective cross-sectional flow area of the composite upstream throat. This is because of the configuration and size of the long tapered inlet passages 52 and the fact that the composite upstream throat is made up of six throats 58*t* and 60*t* of small cross-sectional area, whereas the downstream throat comprises a single orifice 68. Because of the length of the inlet passages 58 and 60, the four wall surfaces forming each passage and the small cross-sectional area of each, there is substantial boundary layer build-up in each passage. In contrast, there is comparatively little boundary layer build-up at the single downstream orifice 68, particularly because of the sharp edges 68*a* and 68*b*.

The ratio of the effective cross-sectional flow area of the downstream throat to the effective flow area of the composite upstream throat is approximately 1.33 to 1 for optimum operation. In order to determine the effective cross-sectional flow area ratio at higher Reynolds numbers, a water flow test is employed to determine experimentally the actual flow per unit time through the downstream throat 68 as compared with the actual flow per unit time through the composite upstream throat 58*t* and 60*t*. First, with the pipe 32 in place, flow of a measured amount of water through the composite upstream throat is timed. Next, the pipe 32 is removed, and flow of the same measured amount of water through the downstream throat 68 is timed. The comparative flow per unit time so determined defines the effective cross-sectional flow area ratio according to the concepts of the invention. It has been determined that the effective cross-sectional flow area ratio can vary between 1.5 and 1.25 and still achieve the uniform range of extremely small droplet sizes according to the invention.

The configuration and location of parts is such that the space between the upper end 55 of the liquid supply pipe 32 and the end wall 62 is considerably greater in effective cross-sectional flow area than the effective cross-sectional flow area of the exit orifice 68. Accordingly, the flow is in no way restricted between the composite upstream throat 58*t* and 60*t* and the downstream throat 68.

In operation of applicant's invention, squeezing of the squeeze bottle 22 creates an internal pressure of 1 to 2 psig which causes liquid to flow upwardly in the passage 54 and causes air to flow upwardly into the grooves 52 comprising the initial portions of the air flow passages 58 and 60. As the air flow in each of the passages passes through the respective throats 58*t* and 60*t* into the diverging portion 61 of the passages, the speed of the flow rapidly accelerates, apparently to supersonic speed. Acceleration to supersonic speed is concluded because shock waves form in the divergent portions 61 of the passage before the air flow reaches the upper end of the liquid pipe 32.

The shock waves which form in the diverging passage 61 are schematically illustrated in FIGS. 9, 10 and 11. The shock waves when formed travel at several times the speed of sound. Some shock waves initially strike the ramp 64 and then are reflected to the opposed upper end surface 55 of the liquid supply pipe 32, such as the shock waves 70, 72, 74 and 76 schematically illustrated in FIGS. 9, 10 and 11. Some reflected shock waves, not illustrated, strike the side walls 66 of the ramped passage 67. Also, it is believed that other shock waves (not shown) may first strike the end wall 62 of the cavity 50 and then be reflected against the end surface 55 of the liquid supply pipe from which they are again reflected upwardly to strike the ramp surface 64. The fact that the energy of the shock waves is not fully dissipated and that reflected waves pass out the exit orifice 68 is determined by visual observation of the external spray, which contains some droplets 28*a* carried 9 or 10 inches to each side of the main spray 28, as illustrated in FIGS. 1, 9 and 12.

In ascertaining the presence of shock waves applicant has taken high speed photographs of the phenomenon, and in many of these photographs the area of impact of the shock waves against various wall surfaces is quite pronounced. The phenomenon shown in the photographs is schematically illustrated in FIG. 9 wherein the shock wave 70 is shown as first impacting the ramp 64 and then reflecting against the upper end surface 55 of the liquid supply pipe 32. The incident shock 70 causes the boundary layer 78 to separate from the wall surface 64, and it reattaches downstream as shown. As the shock wave 70 reflects against the upper end surface 55 of the liquid supply pipe 32, it also causes the boundary layer 80 to separate from that surface as shown. The shock wave reflected from the end surface 55 then passes out the exit orifice 68 as shown. Since only a relatively strong shock wave causes boundary layer separation, the high speed photographs indicate the presence of strong shock waves. Applicant believes that the boundary layer separation phenomenon occurs each time a sufficiently strong shock wave impacts a wall or is reflected against another wall, as explained for example in *Boundary Layer and Flow Control,* Vol. 2, Edited by G. V. Lachmann, Pergamon Press, 1961, Chapter by H. H. Pearcey. For the sake of simplicity the boundary layer separation phenomenon is not shown in FIGS. 10 and 11, but it will be understood that boundary layer separation occurs as the shock waves 72, 74 and 76 impact the surfaces 64 and 55.

The high speed photographs were taken at eight microseconds exposure, and yet the motion of the flow adjacent the end surface 55 of the liquid supply pipe 32 was not completely stopped. This appears to indicate an area of very low pressure and high velocity along the surface 55. This is to be expected because of the high velocity of the air flow in the diverging passages 61 on each side of the liquid supply pipe 32. As the air flow reaches the end surface 55, which is at almost 90° to the planes of the scarfed surfaces 56, extreme turbulence and very low pressure are created adjacent the surface 55 because of the abrupt discontinuity of the surfaces. This creates a strong "suction" which tends to create tension in the column of liquid in the liquid flow passage 54.

While the presence of rapidly recurring shock waves has been established through testing and high speed photography, the underlying physical phenomenon which creates the shock wave is not fully understood. As stated earlier, the presence of shock waves seems to indicate acceleration of the air flow in the diverging passages 61 to supersonic speeds. Also, since only a strong shock wave will cause boundary layer separation, the separation which does occur (FIG. 9) seems to point to air flow velocities which are strongly supersonic. However, the back pressure of only 1 to 2 psig would make it necessary that the pressure at the upstream throats 58*t* and 60*t* drop to approximately 8.82 psia in order to achieve a critical pressure ratio of 0.528 (ratio of pressure at the throat divided by back pressure) which is agreed by the authorities as necessary to achieve sonic velocity at a single throat. Achievement of such a low pressure at the throats 58*t* and 60*t* seems unlikely. Nevertheless, because of the rapidly recurring shock waves which are present, it is assumed that during operation of the spray device the air flow in the diverging passages 61 must turn supersonic and remain supersonic.

Applicant has found that providing a primary air flow as in the air flow passages 58 along with at least one secondary air flow as in the passages 60 is advantageous. With specific reference to FIG. 11, as the air flow in the primary passage 58 passes the throat 58*t* it tends to fan outwardly as depicted, and the same occurs with respect to the air flow through the auxiliary passages 60 as they pass the throats 60*t*. The secondary air flow appears to assist in accelerating the primary flow through entrainment, and in addition it is believed that the secondary flow provides energy to the boundary layer to reduce the flow-impeding effect of boundary layer growth.

As illustrated in FIGS. 9 and 10, when the shock waves impact against a surface they create sonic or ultrasonic vibrations, such as the vibrations 82, 84 and 86 schematically shown in FIGS. 9 and 10. For ease of reference hereinafter and in the claims the vibrations are referred to as "sonic" although the frequencies may be well above the range of 15,000 to 20,000 cycles per second which the human ear can detect. Some of the sonic vibrations which radiate from the area of shock wave impact with the ramp surface 64 as shown in FIGS. 9 and 10 are directed toward the passage 54 causing sonic vibrations to be transmitted downwardly into the liquid confined within the passage before it reaches the end surface 55. The sonic vibrations created in the confined liquid column cause it to fracture before it emerges from the exit aperture of the passage 54, so that when the liquid emerges from the aperture at the surface 55 it does so in the form of a mist 88 comprised of extremely small droplets, schematically illustrated in FIG. 12. As the flow is ejected out the exit orifice 68, it appears that some recombining of droplets has taken place. Nevertheless, it has been determined that the spray 28 which is ejected is composed of droplets of a narrow size range not greater than 50 microns in diameter. As previously mentioned, some droplets 28*a* are ejected as far as 9 to 10 inches to the side of the central or main core spray 28, indicating that reflected shock waves are exiting with the spray.

It has been determined experimentally that in order to provide sonic vibrations effective for fracturing the confined liquid column, the wall surface or surfaces from which the sonic vibrations emanate must be relatively close and opposed to the liquid exit aperture. It will be seen from FIGS. 9, 10 and 11 that this is indeed the case with the positioning and attitude of the ramp surface 64 relative to the exit aperture of the liquid passage 54 at the end surface 55 of the water pipe 32.

The mechanism by which the sonic vibrations (such as 82, 84 and 86 shown in FIGS. 9 and 10) cause fracturing of the confined liquid column is not fully understood. It may be that the fracturing is related to and a step beyond the phenomenon of ultrasonically induced cavitation as explained in *Ultrasonically Induced Cavitation in Water: A Step-by-Step Process,* by G. W. Willard, which appeared in Volume 25, Number 4 of the *Journal of the Acoustical Society of America* for July, 1953, or as explained in *High-Intensity Ultrasonics,* by Basil Brown and John E. Goodman, copyright 1965, published in the U.S.A. by D. Van Nostrand Company, Inc.

Although the present invention has been described as embodied in a hand sprayer in which the input pressure is very low, the concepts of the invention are equally applicable to spray devices in which higher input pressures are achieved.

Variations and modifications may be effected without departing from the scope of the novel concepts of the present invention.

I claim:

1. In liquid atomizing apparatus including a supply of the liquid to be atomized and means providing a confined stream of the liquid, the improvement comprising:
(a) means creating sonic vibrations (22; 52, 56; 58, 60, 58*t*, 60*t*; 61; 64; 68; 70, 72, 74, 76) in the confined stream of liquid to cause the confined liquid to fracture into droplets of relatively uniform size.

2. Liquid atomizing apparatus according to claim 1 in which said means creating sonic vibrations comprises:
(a) a gas flow, and
(b) means for creating shock waves in said gas flow (58*t*, 60*t*, 61; 68).

3. Liquid atomizing apparatus according to claim 2 including a surface (64) against which said shock waves impact to create said sonic vibrations.

4. Liquid atomizing apparatus according to claim 1 in which the size of the droplets is in a range below 50 microns in diameter.

5. Liquid atomizing apparatus according to claim 2 in which said means for creating shock waves include two throats in series (58*t* and 60*t*; 68) for accelerating said gas flow to a velocity sufficient to create said shock waves between said two throats.

6. Liquid atomizing apparatus according to claim 5 in which said two throats include an upstream throat (58*t* and 60*t*) and a downstream throat (68) with the effective cross-sectional flow area of said downstream throat being in the range of between 1.25 and 1.5 times the effective cross-sectional flow area of said upstream throat.

7. A method of atomizing liquid comprising:
(a) creating sonic vibrations (82, 84, 86), and
(b) directing said sonic vibrations into a confined stream of said liquid to cause the liquid to fracture into droplets of relatively uniform size.

8. A method according to claim 7 including:
(a) creating shock waves (70, 72, 74, 76) in a gas flow, and
(b) impacting said shock waves against a surface (64) to create said sonic vibrations.

9. A method according to (claims 7 and 8) claim 7 or 8 including the step of creating tension in said confined stream of liquid.

10. In a liquid atomizing apparatus including means for providing a gas flow and a liquid stream, the improvement comprising:
(a) means (22; 52, 56; 58, 60, 61) including two throats in series (58*t* and 60*t*; 68) for accelerating said gas flow to a velocity sufficient to create shock waves between said throats, and
(b) means including said shock waves for atomizing said liquid stream.

11. Liquid atomizing apparatus according to claim 10 in which said means for atomizing includes means for directing said shock waves (74, 76, 78, 80) against a surface (64) to create sonic vibrations directed into said liquid stream to cause said stream to fracture into droplets of relatively uniform size.

12. Liquid atomizing apparatus according to claim 10 in which said means for accelerating said gas flow includes an upstream throat (58*t*, 60*t*) and a downstream throat (68) with said downstream throat being relatively sharp-edged compared with said upstream throat.

13. Liquid atomizing apparatus according to claim 10 in which said means for accelerating said gas flow includes an upstream throat (58*t*, 60*t*) and a downstream throat (68) with the effective cross-sectional flow area of said downstream throat being in the range of between 1.25 and 1.5 times the effective cross-sectional flow area of said upstream throat.

14. Liquid atomizing apparatus according to claim 10 in which said means for accelerating said gas flow includes an auxiliary gas flow which is injected generally in the flow direction of said first-named gas flow to supply energy to the boundary layer of said first flow and to enhance acceleration of said first flow through entrainment.

15. Liquid atomizing apparatus according to claim 10 in which said means for accelerating said gas flow includes a convergent-divergent nozzle (58, including 58*a* and 61; 60, including 60*a* and 61) with the upstream one of said two throats (58*t*; 60*t*) disposed between the convergent and divergent portions of said nozzle (58*t* between 58*a* and 61; 60*t* between 60*a* and 61).

16. Liquid atomizing apparatus according to claim 15 in which the effective cross-sectional flow area of the downstream one of said two throats (68) is in the range of between 1.25 and 1.5 times the effective cross-sectional flow area of the upstream throat (58*t*, 60*t*).

17. Liquid atomizing apparatus according to claim 10 in which the upstream one of said two throats (58*t* and 60*t*) is a composite throat including two throats in parallel (58*t*, 60*t*) each providing a gas flow with the two gas flows combining downstream of the said parallel throats and with the combined gas flows then passing through the downstream one of said two throats (68) along with the liquid droplets.

18. Liquid atomizing apparatus according to claim 17 in which one of said two parallel throats (60*t*) injects a gas flow downstream of the gas flow injected from the other of said parallel throats (58*t*) to supply energy to the boundary layer of the gas flow from the other of said parallel throats (58*t*) and to accelerate said other flow through entrainment.

19. A method of atomizing liquid comprising the steps of:

(a) creating shock waves (72, 74, 76, 78) in a gas flow injected through a first throat (58*t*; 60*t*) into a passage (61), and (b) utilizing said shock waves (72, 74, 76, 78) to create sonic vibrations in a confined column of liquid to shatter the liquid into small droplets.

20. A method of atomizing liquid comprising the steps of:

(a) creating shock waves (72, 74, 76, 78) in a gas flow injected through a first throat (58*t*; 60*t*) into a passage (61), (b) utilizing said shock waves (72, 74, 76, 78) to create sonic vibrations in an emerging column of liquid to shatter the liquid into small droplets, and (c) ejecting said gas flow and said liquid droplets out a second throat (68) in series with and downstream of said first throat (58*t*; 60*t*).

21. The method according to claim 20 in which said second throat (68) has an effective cross-sectional flow area in the range of between 1.25 and 1.5 times the effective cross-sectional flow area of said first throat (58*t*; 60*t*).

22. A method of atomizing liquid comprising the steps of:

(a) creating shock waves (72), 74, 76, 78) in a gas flow injected through a first throat (58*t*; 60*t*) into passage (61), (b) utilizing said shock waves (72, 74, 76, 78) to create sonic vibrations in an emerging column of liquid to shatter the liquid into small droplets, and (c) injecting an additional gas flow into said passage (61) through a throat (60*t*) in parallel with said first throat (58*t*) to enhance acceleration of said first-named gas flow and to supply energy to the boundary layer of the first-named gas flow.

23. The method according to claim 19 in which said passage (61) is divergent in the downstream direction and in which said shock waves (72, 74, 76, 78) are created by accelerating said gas flow in said divergent passage (61).

* * * * *